US006286833B1

(12) United States Patent
Collins

(10) Patent No.: US 6,286,833 B1
(45) Date of Patent: Sep. 11, 2001

(54) CASINO BOARD GAME

(76) Inventor: Russell S. Collins, 17 Griffin Rd., Manchester, CT (US) 06040

( * ) Notice: Subject to any disclaimer, the term of this patent is extended or adjusted under 35 U.S.C. 154(b) by 0 days.

(21) Appl. No.: 09/405,707

(22) Filed: Sep. 24, 1999

(51) Int. Cl.[7] ..... A63F 3/00

(52) U.S. Cl. ..... 273/243; 273/139; 273/256; 273/138.1; 273/140 D; 273/142 R

(58) Field of Search ..... 273/236, 242, 273/243, 274, 256, 13 S, 138.1, 143 D, 142 R

(56) References Cited

U.S. PATENT DOCUMENTS 3,889,954 * 6/1975 Malisow .
3,936,054 * 2/1976 Garcia .
4,065,131 * 12/1977 Martin .
4,273,337 * 6/1981 Carrera .
4,346,899 * 8/1982 Nuebling .
4,382,602 * 5/1983 Cusick .
5,228,698 * 7/1993 Dubarry .
5,360,216 * 11/1994 Counterman .

* cited by examiner

*Primary Examiner*—Benjamin H. Layno
*Assistant Examiner*—Vishu Mendiratta

(57) ABSTRACT

A casino board game for entertaining and amusing players while simulating a gaming environment. The casino board game includes a game board with a continuous path, divided into marked spaces, located around a perimeter of the board. The game board has two areas for placement of bets, each of which is divided into a red portion and a black portion. A spinning wheel is used to determine the type of action a player will take in the game. The wheel is divided into pie-shaped compartments. Half of the compartments are red and half are black. Each of the compartments directs players to either move a game piece a certain number of spaces, lose a turn or place a wager. A plurality of game pieces are used by the players. A plurality of playing cards either penalize or reward players. A plurality of bidding chips in various denominations are used as money. A plurality of stock cards are representative of a share of stock. A first group of marked spaces indicates movement forward or backward on the path. A second group of marked spaces indicates a player wins the bidding chips. A third group of marked spaces indicates a player is directed to draw one of the cards. A fourth group of marked spaces indicates losing of the bidding chips. A fifth group of marked spaces indicates spinning of the wheel again.

10 Claims, 3 Drawing Sheets

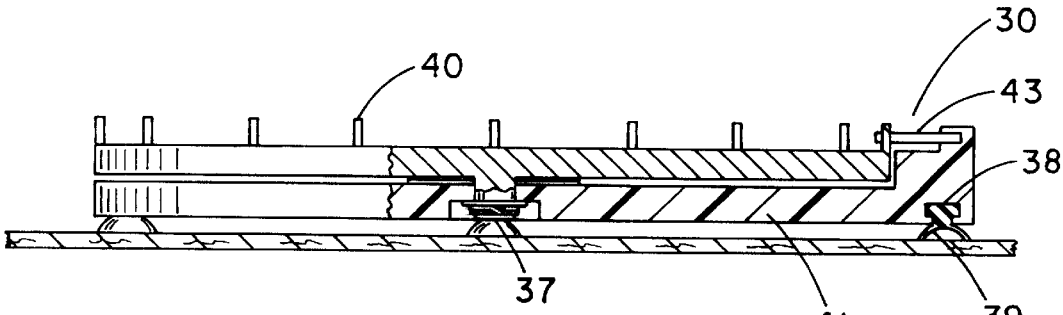
FIG. 2
FIG. 3
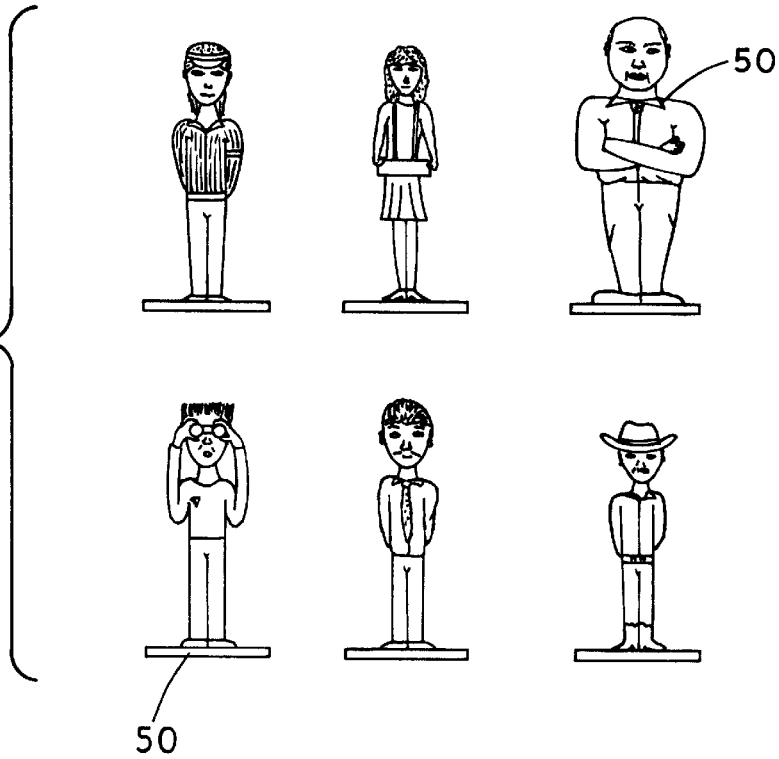

CASINO BOARD GAME

BACKGROUND OF THE INVENTION

1. Field of the Invention

The present invention relates to board games and more particularly pertains to a new casino board game for entertaining and amusing players while simulating a gaming environment.

2. Description of the Prior Art

The use of board games is known in the prior art. More specifically, board games heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,228,698; U.S. Pat. No. 5,169,154; U.S. Pat. No. 4,930,789; U.S. Pat. Des. No. 150,295; U.S. Pat. No. 4,921,249; and U.S. Pat. No. 2,253,787; U.S. Pat. No. 4,109,918; U.S. Pat. No. 3,253,828; U.S. Pat. No. 4,887,819; U.S. Pat. No. 1,632,673.

While these devices fulfill their respective, particular objectives and requirements, the aforementioned patents do not disclose a new casino board game. The inventive device includes a game board with a continuous path, divided into marked spaces, located around a perimeter of the board. The game board has two areas for placement of bets, each of which is divided into a red portion and a black portion. A spinning wheel is used to determine the type of action a player will take in the game. The wheel is divided into pie-shaped compartments. Half of the compartments are red and half are black. Each of the compartments directs players to either move a game piece a certain number of spaces, lose a turn or place a wager. A plurality of game pieces are used by the players. A plurality of playing cards either penalize or reward players. A plurality of bidding chips in various denominations are used as money. A plurality of stock cards are representative of a share of stock. A first group of marked spaces indicates movement forward or backward on the path. A second group of marked spaces indicates a player wins the bidding chips. A third group of marked spaces indicates a player is directed to draw one of the cards. A fourth group of marked spaces indicates losing of the bidding chips. A fifth group of marked spaces indicates spinning of the wheel again.

In these respects, the casino board game according to the present invention substantially departs from the conventional concepts and designs of the prior art, and in so doing provides an apparatus primarily developed for the purpose of entertaining and amusing players while simulating a gaming environment.

SUMMARY OF THE INVENTION

In view of the foregoing disadvantages inherent in the known types of board games now present in the prior art, the present invention provides a new casino board game construction wherein the same can be utilized for entertaining and amusing players while simulating a gaming environment.

The general purpose of the present invention, which will be described subsequently in greater detail, is to provide a new casino board game apparatus and method which has many of the advantages of the board games mentioned heretofore and many novel features that result in a new casino board game which is not anticipated, rendered obvious, suggested, or even implied by any of the prior art board games, either alone or in any combination thereof.

To attain this, the present invention generally comprises a game board with a continuous path, divided into marked spaces, located around a perimeter of the board. The game board has two areas for placement of bets, each of which is divided into a red portion and a black portion. A spinning wheel is used to determine the type of action a player will take in the game. The wheel is divided into pie-shaped compartments. Half of the compartments are red and half are black. Each of the compartments directs players to either move a game piece a certain number of spaces, lose a turn or place a wager. A plurality of game pieces are used by the players. A plurality of playing cards either penalize or reward players. A plurality of bidding chips in various denominations are used as money. A plurality of stock cards are representative of a share of stock. A first group of marked spaces indicates movement forward or backward on the path. A second group of marked spaces indicates a player wins the bidding chips. A third group of marked spaces indicates a player is directed to draw one of the cards. A fourth group of marked spaces indicates losing of the bidding chips. A fifth group of marked spaces indicates spinning of the wheel again.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new casino board game apparatus and method which has many of the advantages of the board games mentioned heretofore and many novel features that result in a new casino board game which is not anticipated, rendered obvious, suggested, or even implied by any of the prior art board games, either alone or in any combination thereof.

It is another object of the present invention to provide a new casino board game which may be easily and efficiently manufactured and marketed.

It is a further object of the present invention to provide a new casino board game which is of a durable and reliable construction.

An even further object of the present invention is to provide a new casino board game which is susceptible of a low cost of manufacture with regard to both materials and labor, and which accordingly is then susceptible of low prices of sale to the consuming public, thereby making such casino board game economically available to the buying public.

Still yet another object of the present invention is to provide a new casino board game which provides in the apparatuses and methods of the prior art some of the advantages thereof, while simultaneously overcoming some of the disadvantages normally associated therewith.

Still another object of the present invention is to provide a new casino board game for entertaining and amusing players while simulating a gaming environment.

Yet another object of the present invention is to provide a new casino board game which includes a game board with a continuous path, divided into marked spaces, located around a perimeter of the board. The game board has two areas for placement of bets, each of which is divided into a red portion and a black portion. A spinning wheel is used to determine the type of action a player will take in the game. The wheel is divided into pie-shaped compartments. Half of the compartments are red and half are black. Each of the compartments directs players to either move a game piece a certain number of spaces, lose a turn or place a wager. A plurality of game pieces are used by the players. A plurality of playing cards either penalize or reward players. A plurality of bidding chips in various denominations are used as money. A plurality of stock cards represent of a share of stock. A first group of marked spaces indicates movement forward or backward on the path. A second group of marked spaces indicates a player wins the bidding chips. A third group of marked spaces indicates a player is directed to draw one of the cards. A fourth group of marked spaces indicates losing of the bidding chips. A fifth group of marked spaces indicates spinning of the wheel again.

Still yet another object of the present invention is to provide a new casino board game that players win by collecting stock which represent buying of the casino.

Even still another object of the present invention is to provide a new casino board game that allows players to gamble using a "roulette style" wheel.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is a schematic cross-sectional view taken along line 2—2 of the present invention.

FIG. 3 is a schematic front view of the game pieces of the present invention.

DESCRIPTION OF THE PREFERRED EMBODIMENT

Figure 1:
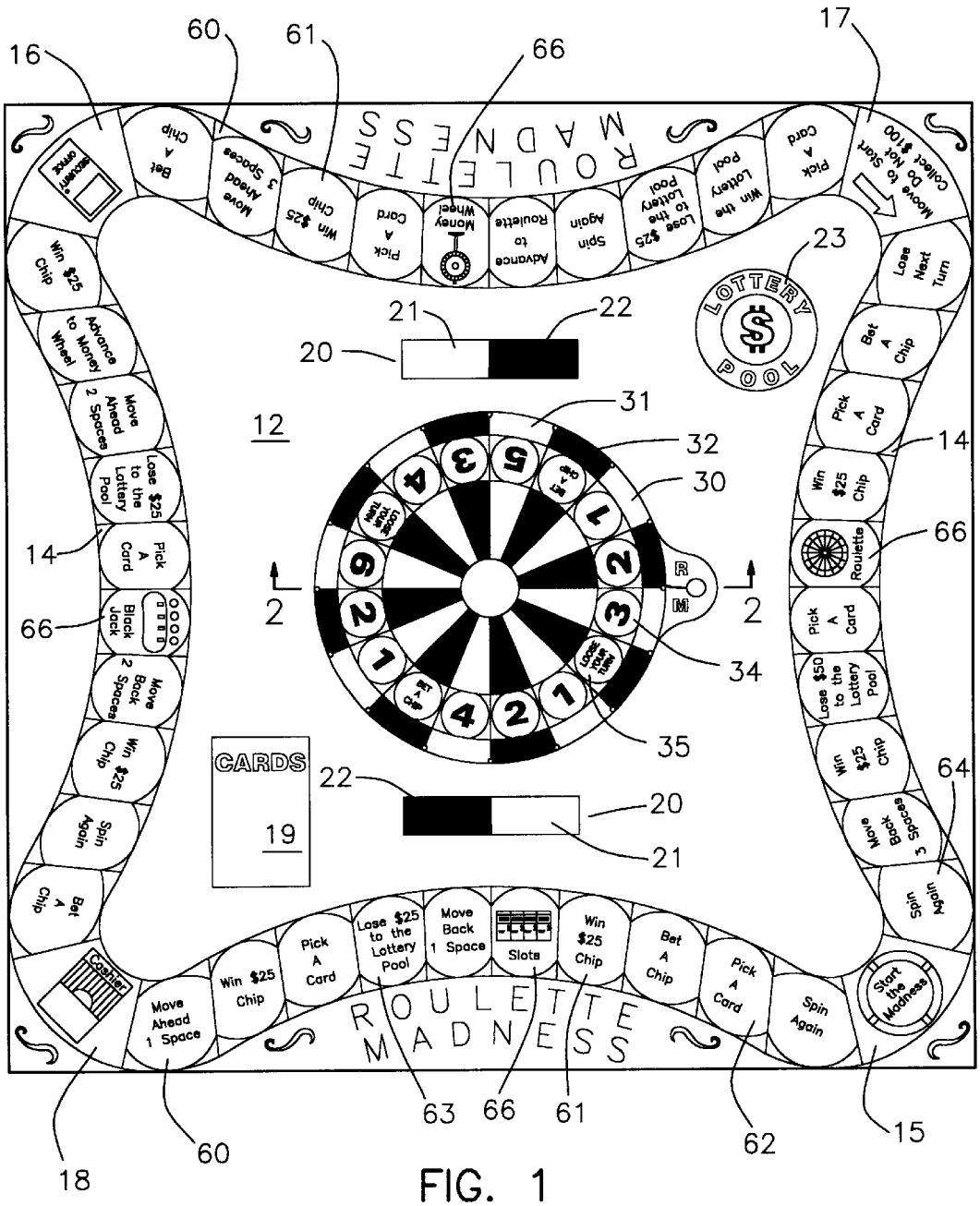
FIG. 1 is a schematic plan view of a new casino board game according to the present invention.
Figure 4:
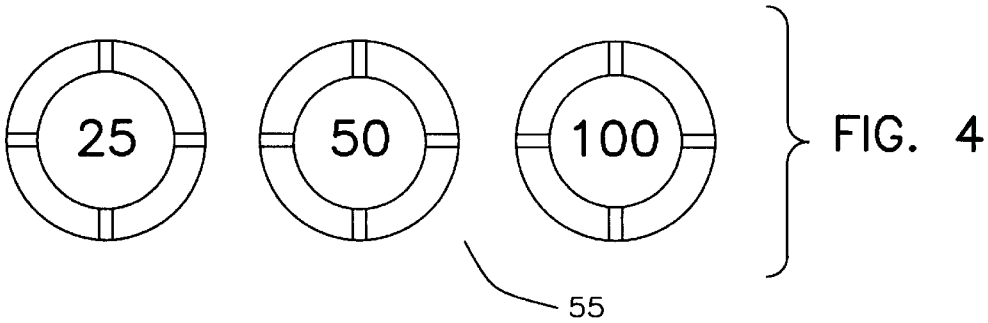
FIG. 4 is a schematic plan view of the betting chips of the present invention.
Figure 5:
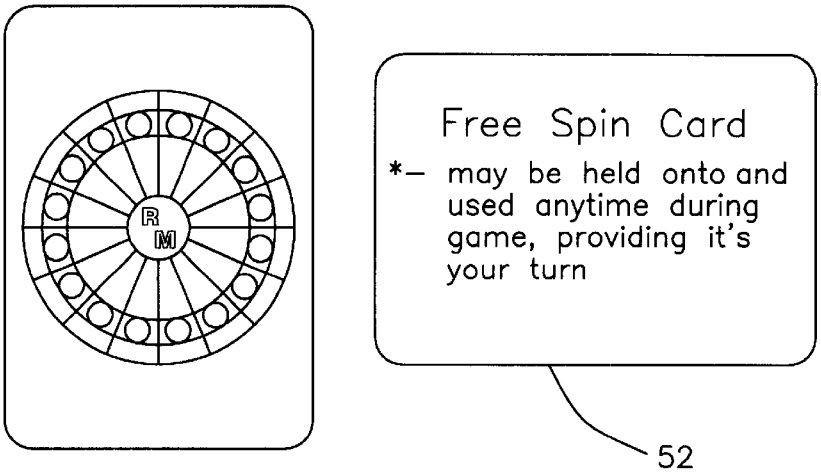
FIG. 5 is a schematic front and back view of the playing cards of the present invention.
Figure 6:
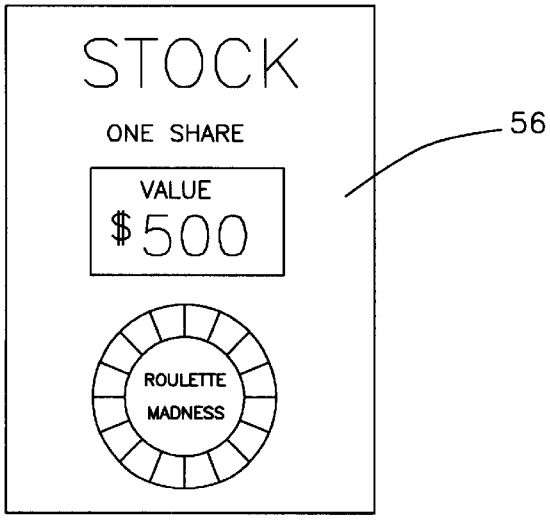
FIG. 6 is a schematic front view of the stock cards of the present invention.

With reference now to the drawings, and in particular to FIGS. 1 through 6 thereof, a new casino board game embodying the principles and concepts of the present invention and generally designated by the reference numeral 10 will be described.

As best illustrated in FIGS. 1 through 6, the casino board game 10 generally comprises a game board 12 with a continuous path 14 marked thereon. The path is located generally around a perimeter of the board and has four corners. The corners are comprised of a starting space 15, a penalty space 16, a payment space 17 and a free space 18. The path is divided into marked spaces. The game board has an indicated area thereon for a stack of cards 19, and is generally rectangular. The game board has two elongated rectangular indicated areas thereon for placement of bets 20. Each of the areas for betting is divided into two portions. A first of the portions 21 of the betting area is red, and a second of the portions of the betting area is black 22. The game board has an indicated area 23 thereon for placement of losses according to rules of the game.

A spinning wheel 30 is used to determine the type of action a player will take in the game. The wheel is located in a center of the game board, and is divided into pie-shaped compartments, wherein every other compartment is black 32 and every compartment between two of the black compartments is red 31. Each of the compartments has indicia therein directing players to move a game piece a certain number of spaces 34, lose a turn 35 or place a wager 36. The indicia preferably includes a greater occurrence of relatively lower values in relation to relatively higher values for thereby increasing odds of getting a lower value upon spinning said spinning wheel (see FIG. 1). The wheel can be a circle, not shown, on the game board with a spinning arrow therein for spinning and determining the outcome of the player's piece. Ideally, The spinning wheel is a disc adapted to rotate on a point 37 located at a center of the wheel. A ridge 38 in the wheel is adjacent to a perimeter of the wheel for stabilizing the wheel on a rail 39. The perimeter of the wheel has elongate members 40 extending away from the wheel in an orientation approximately perpendicular to a plane of the wheel. The wheel has a base 41 which has a rod 42 mounted adjacent to it and extending substantially perpendicular to the surface of the game board. The rod has a protrusion 43 thereon wherein the protrusion extends toward the wheel such that a tip of the protrusion is struck by the elongate members when the wheel is spun. The protrusion determines which of the compartments is selected.

A plurality of game pieces 50 are used by the players to move around the board. Ideally, as indicated in FIG. 3, the pieces have indicia thereon to identify the pieces as casino workers.

Preferably the game comes with a plurality of playing cards 52 having indicia thereon either penalizing or rewarding players. The indicia may relate to any number of circumstances a person would find in a casino. Examples of cards are: go to start to collect $100 chip; you find a lucky penny that really is lucky, collect $100 Chip; move ahead 3 spaces; you gambled and lost your social security check, lose $50 chip to the lottery pool; security catches you smoking in a non-smoking area, go the security office; free spin card, bet a chip and spin again.

A plurality of bidding or betting chips 55 in various denominations are supplied. Ideally the chips come in denominations of $25, $50 and $100. Preferably, the chips are round and have a color corresponding to a specific denomination of money such that all chips of the same denomination have the same color.

A plurality of stock cards 56 have indicia thereon representative of a share of stock. Preferably, each stock is worth $500 worth of bidding chips.

A first indicia on a first group 60 of the marked spaces indicate movement forward or backward on the path. The first group is randomly distributed on the path.

A second indicia on a second group 61 of the marked spaces indicate the player wins a pre-determined amount of bidding chips. The second group is randomly distributed on the path.

A third indicia on a third group 62 of the marked spaces indicate the player is directed to draw one of the cards in accordance with game rules. The third group is randomly distributed on the path.

A fourth indicia on a fourth group 63 of the marked spaces indicate losing of the bidding chips in accordance with game rules. The fourth group is randomly distributed on the path.

A fifth indicia on a fifth group 64 of the marked spaces indicate spinning of the wheel again. The fifth group is randomly distributed on the path.

A sixth indicia on a sixth group 65 of the marked spaces indicate an opportunity for a player to bet one of the chips in accordance with game rules.

A seventh indicia on a seventh group 66 of the marked spaces indicate a free space. The seventh group is randomly distributed on the path. The seventh group is randomly distributed on the path and is preferably named after familiar casino games.

RULES

The object of this game is to be the First player to collect enough stocks 56 to win the game. This is done by collecting enough Casino chips along the way to buy stocks.

Ideally, the moving pieces 50 represent some people identified with a Casino such as the pit boss, waitress, security officer, cashier and a loan shark.

To start the game all players spins the wheel 30. The person with the highest number will go first with the play then moving clockwise. Each player starts out with no chips 55 and moves around the board to collect enough chips to buy stocks 56.

The players take consecutive turns spinning the wheel 30 to determine movement of the players. When a player spins the wheel and lands on placing a wager 36, the player has the option to place a wager or not to place a wager. If placing a wager, whether the player wins or loses, that same player is allowed to spin again. The player places a wager by placing a chip 55 on either the red 21 or black 22 portion of the betting area. The player spins the wheel and if the wheel indicates the color bet, the player receives another chip equal to the one just bet. If the player loses, the money goes into the bank, not shown. If the player does not place a bet, the player spins again.

When a player spins the wheel and the wheel stops on a losing your turn portion 35, the next player in turn spins the wheel.

When a player spins the wheel 50 and lands on a number 34, the player moves their game piece that many spaces on the path. The players begin at the starting space 15 and move clockwise around the path. The spaces are marked with directions the player is to follow. The player may be told to spin again, pick a card, bet a chip, move ahead or behind a number of spaces, move to start with a penalty of not collecting money, or the player may land on various free spaces. If a player lands on a free space, they do nothing and wait for their next turn. If a player lands the penalty corner which directs them to the starting position, the player moves their piece to the starting position and does not collect the typical $100 chip which is given every time a player goes past the starting point of the path. If a player lands on a betting space, the rules for betting are the same as for spinning the wheel and the player may choose not to bet.

Included are playing cards 52 which the player may have to pick up. The cards should be placed face down on the card area 19 on the game board 12. After a player is done with a card he places it at the bottom of the deck. When a player picks up a card that says "Pick-A-Number Card," the player must choose another player to guess the number (#1–3) that is on the card. If the chosen player guesses the number correctly, the player who picked the card goes to start and collects a $100 chip. If the guess is incorrect, the next player begins their turn by spinning the wheel. When picking a card that tells the player to "Advance to" and the new position on the board is located past start, the player advances to the new position on the board and collects a $100 chip. When the player picks a card that tells them to "Lose" an amount, these chips are given to the bank unless otherwise stated on the card. If the player picks a card that says to "Lose a $100 " and the player only has $50, then the player must give the $50.

If the card chosen says "Lose a Chip to Lottery Pool" and you don't have one, the next player automatically spins and the game continues. If you do have one, the chip goes into the area 23 for losses to the lottery pool 23. Players who draw a card to remove chips from the lottery pool may do so provided there are chips available.

Ideally, each stock 56 is valued at five hundred dollars. Stocks can be bought at any time with the betting chips. Players need to collect five shares of stock to win the game. The game may be altered to collect either more or less stocks for a longer or shorter game. If a player owes chips and has none but does have stocks, the stocks need to be cashed in to pay for the debt. When cashed in, the stocks are worth their face value.

Every time a player passes the start space 17, unless due to a directive from a penalty space, the player collects a $100 chip and has the option of betting it at this time.

A player may be sent to the penalty space 16 by a card. The player has the option of paying a $100 chip or loosing the next two turns. When a player lands on the security office, when that player is going around the board, they are just passing through and do not stop for two turns or need to pay a fine.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An apparatus for playing a game for two or more players, comprising:

a game board having a continuous path marked thereon, said path being located generally around a perimeter of the board, said path being divided into marked spaces, said game board having two elongate rectangular indicated areas thereon for placement of bets, each of said areas for betting being divided into two portions, a first of said portions of said betting areas being red, a second of said portions of said betting area being black;

a spinning wheel to determine the type of action a player will take in the game, said wheel being divided into pie-shaped compartments, wherein every other compartment is black and every compartment between two of said black compartments is red, each of said compartments having indicia therein directing players to either move a game piece a certain number of spaces, lose a turn or place a wager, each of said indicia directing players to move a game piece a certain number of spaces has a value, said indicia including greater occurrence of relatively lower values in relation to relatively higher values for increasing odds of getting a lower value upon spinning said spinning wheel, said game board having a rod mounted adjacent to said spinning wheel and extending substantially perpendicular to the surface of the game board, said rod having a protrusion thereon wherein said protrusion extends toward said wheel, said protrusion determining which of said compartments is selected;

a plurality of game pieces;

a plurality of playing cards having indicia thereon either penalizing or rewarding players;

a plurality of bidding chips in various denominations, said chips being round and having a color corresponding to a specific denomination of money;

a plurality of stock cards, said stock cards having indicia thereon representative of a share of stock;

a first indicia on a first group of said marked spaces to indicate movement forward or backward on said path, said first group being randomly distributed on said path;

a second indicia on a second group of said marked spaces to indicate player wins said bidding chips, said second group being randomly distributed on said path;

a third indicia on a third group of said marked spaces to indicate player is directed to draw one of said cards in accordance with game rules, said third group being randomly distributed on said path;

a fourth indicia on a fourth group of said marked spaces to indicate losing of said bidding chips in accordance with game rules, said fourth group being randomly distributed on said path;

a fifth indicia on a fifth group of said marked spaces to indicate spinning of the wheel again, said fifth group being randomly distributed on said path.

2. The apparatus of claim 1 for playing a game for two or more players, wherein said path further having four corners, said corners being comprising a starting space, a penalty space, a payment space and a free space, said game board having an indicated area thereon for a stack of cards, said area for said cards being generally rectangular, said game board having an indicated portion thereon for placement of losses according to rules of the game.

3. The apparatus of claim 1 for playing a game for two or more players, wherein said spinning wheel further comprises:

said spinning wheel being a disc adapted to rotate on a point located at a center of said wheel;

a ridge in said wheel being adjacent to a perimeter of said wheel for stabilizing said wheel on a rail; and said perimeter of said wheel having elongate members extending away from said wheel in an orientation approximately perpendicular to a plane of said wheel.

4. The apparatus of claim 1 for playing a game for two or more players, wherein said game pieces having indicia thereon to identify said pieces as casino workers.

5. The apparatus of claim 2 for playing a game for two or more players, further comprising a plurality of playing cards having indicia thereon either penalizing or rewarding players.

6. The apparatus of claim 5 for playing a game for two or more players, further comprising a fifth indicia on a fifth group of said marked spaces to indicate spinning of the wheel again, said fifth group being randomly distributed on said path.

7. The apparatus of claim 6 for playing a game for two or more players, further comprising sixth indicia on a sixth group of said marked spaces to indicate an opportunity for a player to bet one of said chips in accordance with game rules, said sixth group being randomly distributed on said path.

8. The apparatus of claim 7 for playing a game for two or more players, further comprising a seventh indicia on a seventh group of said marked spaces to indicate a free space, said seventh group being randomly distributed on said path.

9. An apparatus for playing a game for two or more players, comprising:

a game board having a continuous path marked thereon, said path being located generally around a perimeter of the board, wherein said path has flour corners, said corners being comprising a starting space, a penalty space, a payment space and a free space, said path being divided into marked spaces, said game board having an indicated area thereon for a stack of cards, said area for said cards being generally rectangular, said game board having two elongated rectangular indicated areas thereon for placement of bets, each of said areas for betting being divided into two portions, a first of said portions of said betting area being red, a second of said portions of said betting area being black, said game board having an indicated portion thereon for placement of losses according to rules of the game;

a spinning wheel to determine the type of action a player will take in the game, said wheel being located in a center of said game board, said wheel being divided into pie-shaped compartments, wherein every other compartment is black and every compartment between two of said black compartments is red, each of said compartments having indicia therein directing players to either move a game piece a certain number of spaces, lose a turn or place a wager, each of said indicia directing players to move a game piece a certain number of spaces has a value, said indicia including greater occurrence of relatively lower values in relation to relatively higher values for increasing odds of getting a lower value upon spinning said spinning wheel, said spinning wheel being a disc adapted to rotate on a point located at a center of said wheel, a ridge in said wheel being adjacent to a perimeter of said wheel for stabilizing said wheel on a rail, said perimeter of said wheel having elongate members extending away From said wheel in an orientation approximately perpendicular to a plane of said wheel, said game board having a rod mounted adjacent to said spinning wheel and extending substantially perpendicular to the surface of the game board, said rod having a protrusion thereon wherein said protrusion extends toward said wheel such that a tip of said protrusion is struck by said elongate members when said wheel is spun, said protrusion determining which of said compartments is selected;

a plurality of game pieces, said game pieces having indicia thereon to identify said pieces as casino workers;

a plurality of playing cards having indicia thereon either penalizing or rewarding players;

a plurality of bidding chips in various denominations, said chips being round and having a color corresponding to a specific denomination of money;

a plurality of stock cards, said stock cards having indicia thereon representative of a share of stock;

a first indicia on a first group of said marked spaces to indicate movement forward or backward on said path, said first group being randomly distributed on said path;

a second indicia on a second group of said marked spaces to indicate player wins said bidding chips, said second group being randomly distributed on said path;

a third indicia on a third group of said marked spaces to indicate player is directed to draw one of said cards in accordance with game rules, said third group being randomly distributed on said path;

a fourth indicia on a fourth group of said marked spaces to indicate losing of said bidding chips in accordance with game rules, said fourth group being randomly distributed on said path;

a fifth indicia on a fifth group of said marked spaces to indicate spinning of the wheel again, said fifth group being randomly distributed on said path;

a sixth indicia on a sixth group of said marked spaces to indicate an opportunity for a player to bet one of said chips in accordance with game rules, said sixth group being randomly distributed on said path;

a seventh indicia on a seventh group of said marked spaces to indicate a free space, said seventh group being randomly distributed on said path.

10. An apparatus for playing a game for two or more players, comprising:

a game board having a continuous path marked thereon, said path being located generally around a perimeter of the board, wherein said path has four corners, said corners being comprising a starting space, a penalty space, a payment space and a free space, said path being divided into marked spaces, said game board having an indicated area thereon for a stack of cards, said area for card being generally rectangular, said game board having two elongated rectangular indicated areas thereon for placement of bets, each of said areas for betting being divided into two portions, a first of said portions of said betting area being red, a second of said portions of said betting area being black, said game board having an indicated portion thereon for placement of losses according to rules of the game;

a spinning wheel to determine the type of action a player will take in the game, said wheel being located in a center of said game board, said wheel being divided into pie-shaped compartments, wherein every other compartment is black and every compartment between two of said black compartments is red, each of said compartments having indicia therein directing players to either move a game piece a certain number of spaces, lose a turn or place a wager, each of said indicia directing players to move a game piece a certain number of spaces has a value, said indicia including greater occurrence of relatively lower values in relation to relatively higher values for increasing odds of setting a lower value upon spinning said spinning wheel, said spinning wheel being a disc adapted to rotate on a point located at a center of said wheel, a ridge in said wheel being adjacent to a perimeter of said wheel for stabilizing said wheel on a rail, said perimeter of said wheel having elongate members extending away from said wheel in an orientation approximately perpendicular to a plane of said wheel, said wheel having a base, wherein said base having a rod mounted adjacent to said spinning wheel and extending substantially perpendicular to the surface of the game board, said rod having a protrusion thereon wherein said protrusion extends toward said wheel such that a tip of said protrusion is struck by said elongate members when said wheel is spun, said protrusion determining which of said compartments is selected;

a plurality of game pieces, said game pieces having indicia thereon to identify said pieces as casino workers;

a plurality of playing cards having indicia thereon either penalizing or rewarding players;

a plurality of bidding chips in various denominations, said chips being round and having a color corresponding to a specific denomination of money;

a plurality of stock cards, said stock cards having indicia thereon representative of a share of stock;

a first indicia on a first group of said marked spaces to indicate movement forward or backward on said path, said first group being randomly distributed on said path;

a second indicia on a second group of said marked spaces to indicate player wins said bidding chips, said second group being randomly distributed on said path;

a third indicia on a third group of said marked spaces to indicate player is directed to draw one of said cards in accordance with game rules, said third group being randomly distributed on said path;

a fourth indicia on a fourth group or said marked spaces to indicate losing of said bidding chips in accordance with game rules, said fourth group being randomly distributed on said path;

a fifth indicia on a fifth group of said marked spaces to indicate spinning of the wheel again, said fifth group being randomly distributed on said path;

a sixth indicia on a sixth group of said marked spaces to indicate an opportunity for a player to bet one of said chips in accordance with game rules, said sixth group being randomly distributed on said path;

a seventh indicia on a seventh group of said marked spaces to indicate a free space, said seventh group being randomly distributed in said path;

wherein said players choose a playing piece;

wherein said players take turns spinning said wheel to determine the type of action to be take, said actions comprising:

losing a turn if said wheel stops on the lose a turn compartment and allowing the next player to spin;

optionally betting a chip if said wheel stops on said place a wager compartment, said player may bet a chip, said chip being betting chips in various denominations, said bet is made by placing a chip on said red portion of the betting area or said black space of the betting area, the player spins the wheel and wins a second chip of equal value if the color bet is indicated by the wheel, if the player does not bet then that player spins again;

moving an amount of spaces on a game board path indicated by the wheel and performing the action required of said space;

wherein a player may buy stock when they have accumulated enough bidding, chips;

wherein a player must sell stock if said player has a negative balance, negative balances do not carry over to a next turn thereby giving a player with a negative balance a zero balance;

wherein cards are drawn from said card stack, said cards directing said player to either win chips, bet, give another player chips, or pay chips into said losses portion of game board; and wherein a player wins the game by collecting five shares of stock.

* * * * *